US005261673A

United States Patent [19]

Miller

[11] Patent Number: 5,261,673

[45] Date of Patent: Nov. 16, 1993

[54] POLYFUNCTIONAL RACKET FOR USE IN THE GAME OF HIT AND CATCH

[75] Inventor: Howard L. Miller, Albertson, N.Y.

[73] Assignee: Sportdesign, Inc., Plainview, N.Y.

[21] Appl. No.: 867,838

[22] Filed: Apr. 13, 1992

[51] Int. Cl.[5] ..... A63B 59/00

[52] U.S. Cl. ..... 273/346; 273/678; 273/412; 273/DIG. 30

[58] Field of Search ..... 273/327, 346, 412, 67 R, 273/67 B, DIG. 30

[56] References Cited

U.S. PATENT DOCUMENTS

| | | | |
|---|---|---|---|
| 1,558,666 | 10/1926 | Brewer et al. | 273/67 B |
| 4,735,420 | 4/1988 | Seidler | 273/412 |
| 4,919,436 | 4/1990 | Buselli | 273/346 |

FOREIGN PATENT DOCUMENTS

| | | | |
|---|---|---|---|
| 3321343 | 12/1984 | Fed. Rep. of Germany | 273/346 |

*Primary Examiner*—William H. Grieb

*Attorney, Agent, or Firm*—Amster, Rothstein & Ebenstein

[57] ABSTRACT

An article with a polyfunctional front surface is adapted for use in the game of hit and catch with a projectile having an outer surface defined by a multitude of irregular filamentary formations for releasably engaging a mating surface. The article includes a handle and a head, the handle being adapted to be manually gripped, and the head being secured to the handle for movement therewith. The head defines a polyfunctional front surface having at least one first region and at least one second region. The first region is substantially rigid or non-flexible and adapted to cause a rapidly impinging projectile to rebound therefrom, and the second region is substantially flexible and defined by a multitude of irregular filamentary formations adapted to releasably engage the outer surface of an impinging projectile. Thus a projectile impinging on the head front surface will rebound when impinging on the first region and will become engaged when impinging on the second region.

13 Claims, 3 Drawing Sheets

POLYFUNCTIONAL RACKET FOR USE IN THE GAME OF HIT AND CATCH

BACKGROUND OF THE INVENTION

The present invention relates to an article of play, and more particularly to articles of play for use in the game of hit and catch.

One type of articles of play is disclosed in U.S. Pat. No. 4,995,617, entitled "ARTICLES OF PLAY FOR USE IN THE GAME OF CATCH." The articles can be used in the game of catch only and cannot be used in the game of hit or hit and catch.

Another type of racket or paddle-like article of play is disclosed in U.S. Pat. No. 5,080,374 to Chien Ping Yu, entitled "ARTICLES OF PLAY FOR USE IN THE GAME OF HIT AND CATCH," the disclosure of which is incorporated herein by reference. The article can be used in the game of both hit and catch since one of the major outer surfaces of the racket (e.g., the back) is a hard surface devoid of any irregular filamentary formations such as minihook and miniloop materials (e.g., the so-called VELCRO assembly material) and the opposed outer major surface (e.g., the front) is formed of a multitude of such irregular filamentary formations disposed on a flexible inner layer. The flexible inner layer is preferably made of a foamed or spongy material which enables the overlying outer surface to give slightly, thereby deadening the rebound from that surface and enabling that outer surface to capture the outer surface of a projectile impinging thereon where the outer surface of the impinging projectile is similarly formed with a complementary multitude of irregular filamentary formations. While the racket according to this patent enables a game of hit and catch to be played since the projectile or ball will either rebound from the hard surface or become engaged on the flexible filamentary surface (depending upon whether the projectile impinges upon the back surface or the front surface), it has not proven to be entirely satisfactory in use.

Since the racket must be rotated 180° within the hand of the user if, for the same forehand or backhand action, the racket is to be switched between a "hit" and "catch" orientation, children may lack the coordination necessary to reliably effect such a change in orientation in the limited time available. Indeed, the racket may be accidentally dropped during the attempt. Furthermore, continued changes of orientation may be injurious to the elbow of a player due to the rotary twisting action required. Finally, if the object of the game is to take the opponent unawares (so that he does not know whether you will be using a "hit" or "catch" orientation), the need to rotate the racket 180° in orientation may enable the opponent to detect in advance of contact between the racket and the projectile a change in orientation of the racket relative to your hand.

Accordingly, it is an object of the present invention to provide a racket which can be used in a game of both hit and catch.

Another object is to provide such a racket which does not require a 180° rotation in order to switch between "hit" and "catch" orientations.

A further object is to provide such a racket which may be in the form of a mitt.

It is also an object of the present invention to provide such a racket wherein the manner of use does not permit an opponent to determine whether a projectile will be hit or caught by the racket in advance of contact between the racket and the projectile.

SUMMARY OF THE INVENTION

It has now been found that the above and related objects of the present invention are obtained in an article with a polyfunctional surface adapted for use in the game of hit and catch with a projectile having an outer surface defining a multitude of irregular filamentary formations for releasably engaging a mating surface. The article comprises a handle having a first portion configured and dimensioned to be manually gripped and a head secured to the handle for movement therewith. The head defines a polyfunctional front surface having at least one first region and at least one second region. The first region is substantially rigid or non-flexible and adapted to cause an impinging projectile to rebound therefrom, and the second region is substantially flexible and defined by a multitude of irregular filamentary formations adapted to releasably engage the outer surface of an impinging projectile. Thus, a projectile impinging on the front surface of the head will rebound when impinging on the first region and will become engaged when impinging on the second region.

The first region is adapted to hit an impinging projectile, and the second region is adapted to catch an impinging projectile. The first and second regions are preferably disposed in the same plane of the front surface of the head.

In a preferred embodiment, the front surface of the second region and the outer surface of the projectile are selected one from a multitude of miniloops and the other from a multitude of resilient minihooks, the minihooks and miniloops being adapted to releasably engage upon contact. Each of the first and second regions have front surfaces defined by a multitude of irregular filamentary formations for releasably engaging an outer surface of the projectile and differ only in the flexibility thereof. Alternatively, however, the second region has a front surface defined by a multitude of irregular filamentary formations for releasably engaging the outer surface of the projectile, and the first region does not.

Where the article is in the configuration of a paddle or racket, the handle has a second portion longitudinally spaced from the first portion, and the head is secured to the second portion. Where the article is in the configuration of a mitt, the first portion of the handle is disposed on the back surface of the head. The first and second regions may be generally concentrically disposed on the head. Preferably, the front surface of the head has a plurality of one of the first and second regions and only one of the other of the first and second regions.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
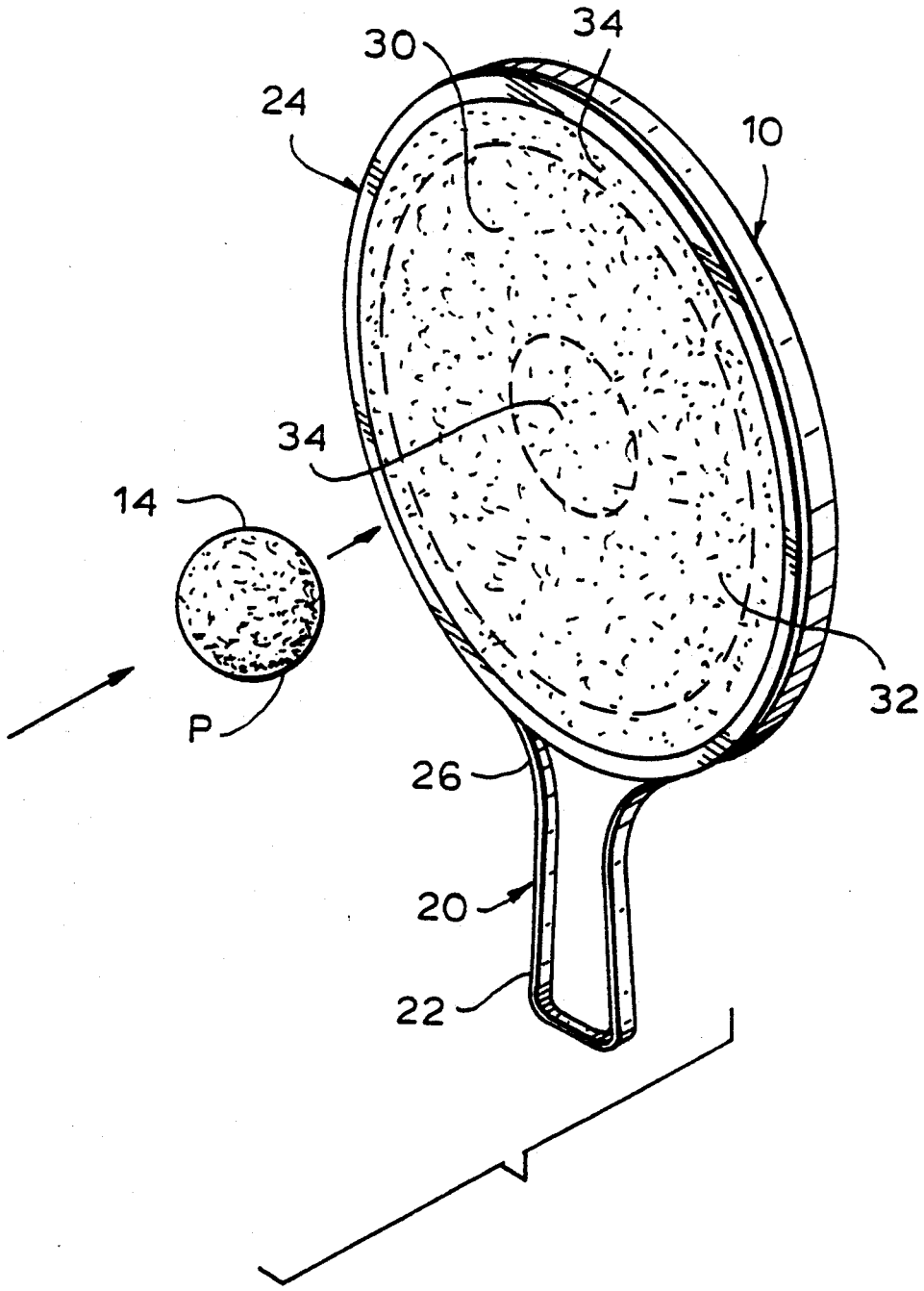
FIG. 1 is a perspective view of a racket-like embodiment of an article according to the present invention as used in a game of hit and catch with a projectile.

Referring now to the drawing, and in particular to FIG. 1 thereof, therein illustrated, in conjunction with a Projectile P, is an article according to the present invention, generally designated by the reference numeral 10. The article 10 has a polyfunctional front surface adapted for use in the game of hit and catch wherein the projectile P may either be hit or caught by the article 10 according to the intention and skill of the player.

The projectile P, which may be in the form of a ball, a dart, or the like, has an outer surface 14 defined by a multitude of irregular filamentary formations for releasably engaging a mating surface. For example, the outer surface 14 may be one of the two mating components of a material available under the trademark VELCRO (available from The Velcro Company). Both of the components of the VELCRO material are composed of a multitude of irregular filamentary formations, one component having a multitude of miniloops and the other component having a multitude of resilient minihooks, the minihooks and miniloops being adapted to releasably engage upon contact. Preferably the projectile outer surface 14 defines a multitude of the miniloops since the miniloop material is felt-like and, if it accidentally contacts the bare skin of a human, does less abrasive damage than would the mating material composed of resilient minihooks.

The article 10 comprises a handle generally designated 20 having a first portion 22 configured and dimensioned to be manually gripped by the player, and a head generally designated 24 secured to the handle 20 for movement therewith. The handle 20 and head 24 may be of integral, unitary, one-piece construction with each other or separate elements secured together.

Figure 3:
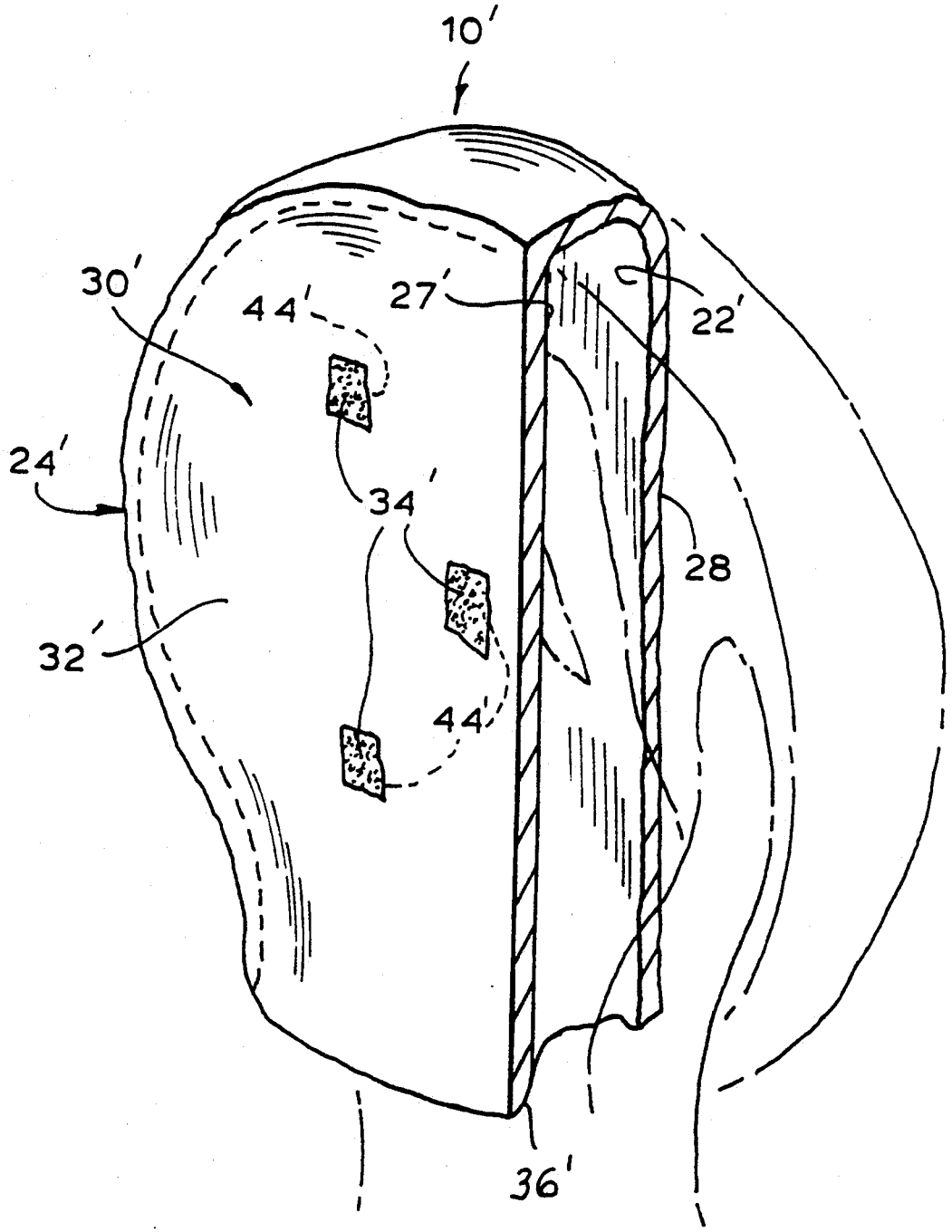
FIG. 3 is a fragmentary perspective view of a mitt-like embodiment of the article, with portions removed to reveal details of internal construction and a hand illustrated therein in phantom line.

As illustrated in FIG. 1, a first embodiment 10 of the article is in the configuration of a paddle or racket with the handle 20 having a second portion 26 longitudinally spaced from the first portion 22 thereof, and the head 24 being secured to the handle second portion 26. Alternatively, however, as illustrated in FIG. 3, a second embodiment 10' of the article may be in the configuration of a mitt with the handle first portion 22' being disposed on the head back surface 27. In order to make the mitt-like article more closely resemble a mitt, a back cover 28 may be provided for the head 24' so that the player's hand grasps the handle first portion 22' intermediate the back cover 28 and the head 24'.

The head 24 defines a polyfunctional front surface, generally designated 30, having at least one first region 32 and at least one second region 34. The first region 32 is substantially rigid or non-flexible and is adapted to cause an impinging projectile P to rebound therefrom. The second region 34 is substantially flexible and defined by a multitude of irregular filamentary formations adapted to releasably engage the outer surface 14 of an impinging projectile P. The irregular filamentary formations of the second region 34 are preferably formed of a mating component of a VELCRO assembly, as described above, so that the mating surface of the second region 34 is adapted to releasably engage the outer surface 14 of the projectile P. Thus a projectile P impinging on the polyfunctional front surface 30 of the head 24 of the article 10 will be rebound therefrom when impinging on the first region 32 (especially if it rapidly impinges thereon) and will become engaged therewith when impinging on the second region 34.

As an example, the article 10 may be formed of a substantially rigid wood or plastic with recessed areas formed on the front surface thereof and filled with a laminate having a front layer of a multitude of irregular filamentary formations and a back layer of substantially flexible material (such as foam or sponge).

Preferably the first and second regions 32, 34 of the head front surface 30 are disposed in the same plane—namely, they define a planar front surface 30 of the head 24. While the first and second regions 32, 34 may be disposed in different parallel planes of a non-planar front surface, the angled or inclined surfaces connecting the different planes can produce irregular rebounds of the projectile P and interfere with secure catching of the projectile P, and thus are preferably avoided.

Regardless of whether the first and second regions 32, 34 are disposed in the same or different planes of the head front surface 30, the first region 32 may lack the multitude of irregular filamentary formations (for releasably engaging the outer surface 14 of the projectile P) found on the second region 34. As evident in FIG. 3, this arrangement results in an article 10' having an irregularly appearing front surface 30', even when the first and second regions 32', 34' are disposed in the same plane, since only the second region 34' has its front surface defined by a multitude of irregular filamentary formations and the first region 32' does not. Accordingly, in the preferred embodiment of the present invention illustrated in FIGS. 1 and 2, each of the first and second regions 32, 34 have front surfaces defined by a multitude of irregular filamentary formations (preferably formed of minihooks) for releasably engaging the outer surface 14 of the projectile P (preferably formed of miniloops) and differ only in the flexibility thereof. This results in the entire head front surface 30 having a uniform appearance (defined by the multitude of irregular filamentary formations), the difference in flexibility not being visually apparent. Where the head front surface 30 is uniformly composed of a multitude of irregular filamentary formations, and the first and second regions 32, 34 therefore differ only in their flexibility, the article 10 relies on the well-recognized fact that a rapidly impinging projectile P (with an outer surface covered with a multitude of irregular filamentary formations) is very likely to rebound from a rigid or inflexible region covered with a multitude of irregular filamentary formations, but is very likely to become caught on a similarly covered flexible region which can absorb the impact, thus ensuring that the two mating surfaces are in contact long enough for the engagement therebetween to occur.

Figure 2:
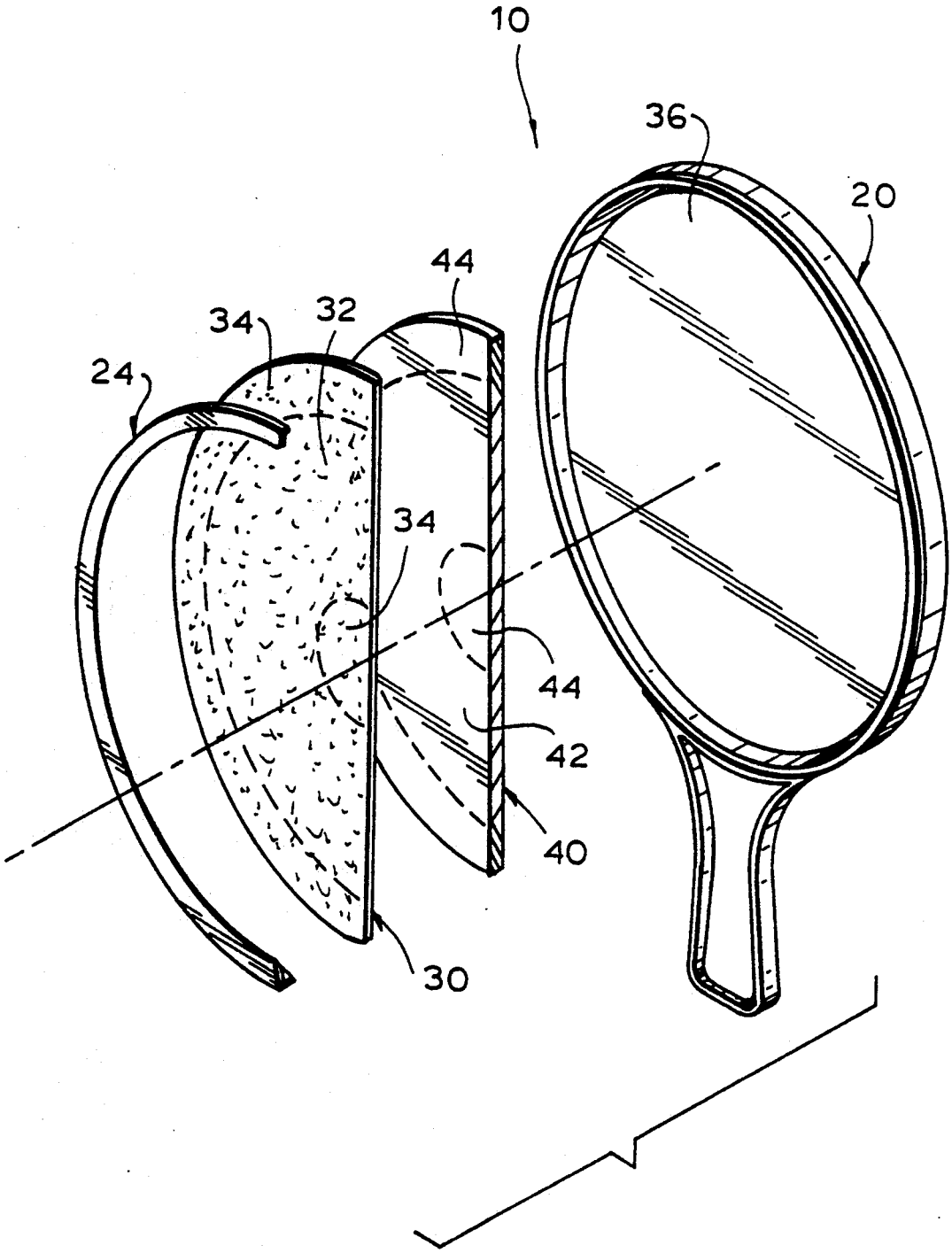
FIG. 2 is an exploded view of the article.

In such a head 24 with a uniform front appearance, the various regions 32, 34 of differing flexibility may be formed by applying, intermediate the base 36 of the head 24 and the front surface 30 of the head 24, an intermediate layer 40 of regular thickness (when not compressed) having substantially rigid or non-flexible areas 42 aligned with the first regions 32 and substantially flexible regions 44 aligned with the second regions 34 (as evidenced by the difference in cross-sectional hatching in FIG. 2. Of course, depending upon the particular structure employed for the article head 24, different techniques may be employed to produce the various regions of differing flexibility. For example, instead of employing an intermediate layer 40 between the entire head base 36 and the entire head front surface 30, as indicated in FIGS. 1 and 2, the back of the front surface 30' may have secured thereto regions of rigid material (e.g., the head base 36 itself) aligned with the first regions 32', and regions 44' of substantially flexible material aligned with and behind the second regions 34', as indicated in FIG. 3. The substantially flexible material may be made of any suitable foamed or spongy materials, while the relatively hard regions may be formed of rigid plastic materials (such as acrylic) or wood. In any case, the first region 32 is adapted to hit an impinging projectile P so as to cause it to rebound therefrom, while the second region 34 is adapted to catch an impinging projectile P (whether rapidly or slowly impinging) and releasably maintain it on the second region 34.

Depending upon the particular size of the articles 10, the types of hit and catch games in which they would be used, and the like, the number and disposition of the first and second regions 32, 34 may vary greatly. For example, the head front surface 30 may have only one of each region 32, 34, a plurality of each region 32, 34, or a plurality of one of the regions 32, 34 and only one of the other regions 34, 32. For example, as illustrated in FIG. 1, a radially spaced pair of regions of one type 34 may be generally concentrically disposed on the head (to form inner and outer second regions 34) with a region of the other type 32 therebetween or, as illustrated in FIG. 3, there may be a plurality of spaced apart regions of one type 34' on a background of a region of the other type 32'. For example, an article 10 having a head 24 with a 6 inch diameter may have a centrally disposed 2 inch diameter inner circle as the second region 34, a 2 inch wide peripheral border as the second region 34, a plurality of 1×1 inch squares (for example, five, as illustrated in FIG. 3) disposed on the front surface as the second regions 34, or combinations thereof.

Because the head front surface 30, 30' is polyfunctional, the article 10, 10' does not have to be reoriented in the player's hand in order to switch between hit and catch functions. Accordingly, there is less chance of the article being dropped during play or the type of injuries which can occur from the rotary motion required to reorient the prior art article. Furthermore, since no reorientation of the article is required to switch between hit and catch orientations, the article may more readily be in the form of either a standard paddle or racket (where the head is at the end of the axially extending handle remote from the grip) or in the form of a mitt (where the handle is disposed behind the head). In order to selectively hit or catch the projectile P, the player has only to ensure that the projectile impinges upon the appropriate region 32, 34 or 32', 34' of the head front surface 30, 30'.

If desired, the first and second regions 32, 34 or 32', 34' may be differently colored to facilitate the player appropriately positioning the selected type of region for impingement by the projectile P. Alternatively, the game may be made harder by not visibly distinguishing between the first and second regions 32, 34 or 32', 34' of the head front surface 30, 30' so that it is not immediately visually apparent, even to the player, which regions of the article front surface 30, 30' will have what effect on the impinging projectile P.

The front surface 30 and the backing 40 may be joined to the head base 36 by conventional means—for example, using a rim 50 as taught by the aforementioned Yu U.S. Pat. No. 5,080,374.

In play, the article 10, 10' can be used to catch the projectile P (by causing it to impinge on the second region areas exclusively) or to hit the projectile P and maintain a volley going (by causing it to impinge on the first region areas exclusively).

Referring now to FIG. 3, therein illustrated is a second embodiment 10' of the article for use in the game of hit and catc, but in the configuration of a mitt or glove (like a catcher's glove). The mitt 10' is adapted to receive a player's hand intermediate the back covering 28 and the rear 27 of the front surface 30'. The front surface 30' has a background of a rigid first region 32' which is devoid of irregular filamentary formations and a plurality (for example, 5) of small second regions 34' which contain irregular filamentary formations (such as the hook-like VELCRO material) with a backing 44' of flexible material so as to render the second regions 34' flexible and capable of engaging an impinging projectile P. The second regions 34 may either be in the same plane as the first region 32 (as illustrated) or projecting forwardly therefrom. Where the first and second regions 32', 34' are situated in the same plane, the first region 32' may define recesses configured and dimensioned to receive the second regions 34 and the flexible backings 44' thereof.

To summarize, the present invention provides an article which can be used in the game of both hit and catch, the article not requiring rotation to switch between the "hit" and "catch" orientations. The article may be in form of a paddle or racket with a longitudinally extending handle or in the form of a mitt. The manner of using the article does not permit the opponent to determine whether the projectile will be hit or caught by the racket in advance of contact between the racket and the projectile, as no 180° re-orientation of the racket head is required.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. An article with a polyfunctional front surface adapted for use in the game of hit and catch with a projectile having an outer surface defining a multitude of irregular filamentary formations for releasably engaging a mating surface, said article comprising:

(A) a handle having a first portion configured and dimensioned to be manually gripped; and (B) a head secured to said handle for movement therewith, said head defining a polyfunctional front surface having a peripheral margin, at least one first region inwardly disposed from and not a part of said peripheral margin, and at least one second region;

(i) said first region being substantially rigid or nonflexible and adapted to cause a rapidly impinging projectile to rebound therefrom, and (ii) said second region being substantially flexible and defined by a multitude of irregular filamentary formations adapted to releasably engage the outer surface of an impinging projectile;

whereby a projectile impinging on said front surface of said head will rebound therefrom when rapidly impinging on said first region and will become engaged therewith when impinging on said second region.

2. The article of claim 1 wherein said first and second regions are disposed in the same plane of said front surface of said head.

3. The article of claim 1 wherein each of said first and second regions have front surfaces defined by a multitude of irregular filamentary formations for releasably engaging an outer surface of the projectile and differ only in the flexibility thereof.

4. The article of claim 1 wherein said second region has a front surface defined by a multitude of irregular filamentary formations for releasably engaging the outer surface of the projectile, and said first region does not.

5. The article of claim 1 wherein the front surface of said second region and the outer surface of the projectile are selected one from a multitude of miniloops and the other from a multitude of resilient minihooks, the minihooks and miniloops being adapted to releasably engage upon contact.

6. The article of claim 1 wherein said first and second regions are generally concentrically disposed on said head.

7. The article of claim 1 wherein said front surface of said head has a plurality of one of said first and second regions and only one of the other of said first and second regions.

8. The article of claim 1 wherein said first region is adapted to hit a rapidly impinging projectile and said second region is adapted to catch an impinging projectile.

9. The article of claim 1 in the configuration of a paddle, wherein said handle has a second portion longitudinally spaced from said first portion, and said head is secured to said second portion.

10. The article of claim 1 in the configuration of a mitt, wherein said first portion of said handle is disposed on the back surface of said head.

11. The article of claim 1 wherein said at least one first region is non-continuous with and spaced apart from said peripheral margin.

12. An article with a polyfunctional front surface adapted for use in the game of hit and catch with a projectile having an outer surface defining a multitude of irregular filamentary formations for releasably engaging a mating surface, said article comprising:

(A) a handle having a first portion configured and dimensioned to be manually gripped; and (B) a head secured to said handle for movement therewith, said head defining a polyfunctional front surface having a peripheral margin, at least one first region inwardly disposed from and not a part of said peripheral margin, and at least one second region;

(i) said first region being substantially rigid or non-flexible and adapted to cause a rapidly impinging projectile to rebound therefrom, and (ii) said second region being substantially flexible and defined by a multitude of irregular filamentary formations adapted to releasably engage the outer surface of an impinging projectile;

said first and second regions being disposed in the same plane of said front surface of said head, the front surface of said second region and the outer surface of the projectile being selected one from a multitude of minihooks, the minihooks and miniloops being adapted to releasably engage upon contact, and said first region being adapted to hit a rapidly impinging projectile and said second region being adapted to catch an impinging projectile;

whereby a projectile impinging on said front surface of said head will rebound therefrom when rapidly impinging on said first region and will become engaged therewith when impinging on said second region.

13. The article of claim 12 wherein at least one first region is non-continuous with and spaced apart from said peripheral margin.

* * * * *